US005646718A

United States Patent [19]

Suwa et al.

[11] Patent Number: 5,646,718

[45] Date of Patent: Jul. 8, 1997

[54] CLEANING BLADE FOR USE IN ELECTROPHOTOGRAPHY, PROCESS CARTRIDGE AND IMAGE FORMING APPARATUS

[75] Inventors: Koichi Suwa, Ushiku; Junichi Kato; Tadashi Onimura, both of Toride; Satoru Inami, Kashiwa; Jun Suzuki, Numazu; Atsutoshi Ando, Kashiwa; Hiroyasu Seita, Shiga-ken, all of Japan

[73] Assignee: Canon Kabushiki Kaisha, Tokyo, Japan

[21] Appl. No.: 677,445

[22] Filed: Jul. 2, 1996

[30] Foreign Application Priority Data

Jul. 7, 1995 [JP] Japan ..... 7-172553

[51] Int. Cl.[6] ..... G03G 15/00

[52] U.S. Cl. ..... 399/350

[58] Field of Search ..... 355/296, 299; 399/346, 350; 15/256.5; 430/125

[56] References Cited

U.S. PATENT DOCUMENTS 4,757,349 7/1988 Toshimitsu et al. .

5,211,864 5/1993 Godlove ..... 355/299 X 5,321,482 6/1994 Yano et al. ..... 355/299

5,363,182 11/1994 Kuribayashi et al. ..... 355/299

5,438,400 8/1995 Kuribayashi et al. ..... 355/299

5,450,184 9/1995 Yanai et al. ..... 355/299

*Primary Examiner*—Robert Beatty

*Attorney, Agent, or Firm*—Fitzpatrick, Cella, Harper & Scinto

[57] ABSTRACT

A cleaning device for an electrophotographic apparatus including an image carrier has a cleaning blade with an edge slidably contracting with an image carrier to remove foreign matter remaining on a surface of the image carrier. A lubricant including indefinite-form lubricant particles is applied to zones on the edges of the cleaning blade near both longitudinal ends of the cleaning blade and a lubricant including spherical lubricant particles is applied to a zone on the edge of the cleaning blade between the zones to which the lubricant including indefinite-form lubricant particles has been applied. A process cartridge includes the cleaning device, and an image forming apparatus incorporates the process cartridge.

17 Claims, 7 Drawing Sheets

CLEANING BLADE FOR USE IN ELECTROPHOTOGRAPHY, PROCESS CARTRIDGE AND IMAGE FORMING APPARATUS

BACKGROUND OF THE INVENTION

1. Field of the Invention

The present invention relates to a cleaning device for use in an electrophotographic image forming apparatus such as a copying apparatus or a laser beam printer. The present invention alsao relates to an electrophotographic process cartridge incorporating such a cleaning device and an image forming apparatus which detachably incorporates such a process cartridge.

2. Description of the Related Art

FIG. 11 illustrates a known cleaning device which is used for the purpose of removing residual toner and other foreign matter remaining on an image carrier in an electrophotographic image forming apparatus.

In the operation of the electrophotographic image forming apparatus, a toner image corresponding to image information is formed on a cylindrical photosensitive member (referred to as "photosensitive drum", hereinafter) which serves as the image carrier, through an image forming process having sequential steps such as charging, exposure, and development. The toner image thus formed is transferred from the surface of the photosensitive drum 1 to a transfer member such as a paper sheet through an image transferring step.

In this image transferring step, part of the toner on the photosensitive drum 1 remains without being transferred to the transfer member. Such toner remaining on the photosensitive drum will be referred to as "residual toner". Such residual toner and other foreign matter is removed by a cleaning device 6.

The cleaning device 6 has a resilient cleaning blade 60, a receiving sheet (referred to also as an "anti-blowing member") 6*a* for preventing blowing out of the toner, and a cleaning vessel 6*b* which supports the cleaning blade 60 and the receiving sheet 6*a*. The cleaning blade 60 has a tabular supporting metal sheet 61 and a rubber tip member 62. A predetermined level of pressure is applied to two portions of the cleaning blade 60 so that the edge portion 62*a* of the rubber tip member 62 is pressed at a suitable level of pressure onto the surface of the photosensitive member 1.

As the photosensitive drum 1 rotates in the direction of the arrow R1, the residual toner on the photosensitive drum 1 is brought to the region where the rubber tip member 62 contacts the surface of the photosensitive drum 1, so that the residual toner is scraped off the photosensitive drum surface by the edge of the rubber tip member 62 so as to be collected in the cleaning vessel 6*b*. The receiving sheet 6*a* is disposed upstream of the cleaning blade 60 as viewed in the direction of rotation of the photosensitive drum 1 and is held in contact with the surface of the photosensitive drum 1, thus preventing the removed toner from falling or being blown off in a downward direction.

As the number of the image transfer cycles increases due to repeated production and transfer of images, residual toner and other foreign matter is gradually accumulated in the region where the rubber tip member 62 of the cleaning blade 60 contacts the surface of the photosensitive drum 1, i.e., in the vicinity of the edge 62*a*. The foreign matter, in addition to the residual toner, include, for example, dust generated due to grinding of the photosensitive surface of the photosensitive drum 1. The toner and other foreign matter thus accumulated serve as a "lubricant". Thus, a lubricating effect cannot be obtained while the accumulation of the toner and other foreign matter is still small, i.e., at the beginning of the use of the cleaning device 6. Consequently, there is a considerably high level of friction between the photosensitive drum 1 and the cleaning blade 60 when the use of the cleaning device 6 has just started, leading to problems or troubles such as a increase in the level of the torque required for driving the photosensitive drum 1, generation of noise and, in some cases, roll-up or turn-over of the rubber tip member 62 of the cleaning blade 60 downstream as viewed in the direction of rotation of the photosensitive drum 1.

In order to eliminate these problems, hitherto, it has been a common practice to apply a lubricant L to the edge 62*a* of the rubber tip member 62 of the cleaning blade 6 before the cleaning blade is put to use, thus reducing the friction acting between the photosensitive drum 1 and the cleaning blade 60 in the break-in period of the cleaning device 6.

Lubricants conventionally used are sorted according to shape into two types: namely, a spherical particle-type lubricant and an indefinite-form, particle-type lubricant. These two types of lubricants have their own problems when put to use.

The spherical, particle-type lubricant provides a superior lubrication effect due to the sphericity of the particles, but tends to be separated from the edge 62*a* of the cleaning blade 60. It is therefore often experienced that the lubricant of this type comes off the edge portion due to vibration of the edge portion 62*a*. For instance, when a contact-type charging member is used for the purpose of electrostatically charging the photosensitive drum 1, the portions of the drum surface around the regions contacted by both end portions of the contact-type charging member tend to be roughened due to extraordinary discharge, resulting in a local increase in the friction coefficient at these portions of the drum surface. When the edge 62*a* of the cleaning blade 60 contacts these roughened portions, the edge 62*a* minutely vibrates to release the lubricant. The portion of the edge 62*a* devoid of the lubricant exhibits rapid wear of the material of the tip member and, in the worst case, triggers the aforesaid turn-over of the cleaning blade. One of effective measure for eliminating such a problem is to increase the amount of the spherical-particle type lubricant initially applied to the edge 62*a* so as to maintain the lubricant on the edge 62*a* for a longer time. Increasing of the amount of lubricant applied causes the amount of the lubricant coming off the edge 62*a* to be increased correspondingly. The freed lubricant existing on the photosensitive drum 1 tends to impair the image exposure so as to promote degradation of the quality of product images.

The lubricant of the second-mentioned type, i.e. the, indefinite-form, particle-type lubricant, exhibits a greater adhesion to the edge 62*a* than the spherical, particle-type lubricant, so that the lubrication effect lasts for a relatively long time, thus obviating the above-described problem encountered with the use of spherical, particle-type lubricant. The indefinite-form, particle-type lubricant, however, exhibits a lubricating effect which though long-lasting is smaller than that exhibited by the spherical, particle-type lubricant. When this type of lubricant is used, therefore, noise tends to be generated due to vibratory action of the cleaning blade 60 on the photosensitive drum 1, in the initial period of use of the cleaning device before the lubrication effect produced by accumulated toner and other matter grows to a sufficiently high level, particularly when the friction between the cleaning blade 60 and the photosensitive drum 3 is increased due to softening of the cleaning blade 60, which takes place when the temperature is elevated. In order to overcome this problem, hitherto, it has been necessary to lower the friction coefficient of the surface of the photosensitive drum 1 or to reduce the pressure of contact of the cleaning blade 60 within a range, which does not substantially impair the cleaning performance.

The use of either the spherical particle-type lubricant or the indefinite-form, particle-type lubricant alone poses various restrictions in the design in regard to the condition of application of the lubricant, the condition of contact of the resilient cleaning blade, coefficient of friction of the photosensitive drum 1 and so forth, in order that all the requirements are met by the single type of lubricant.

SUMMARY OF THE INVENTION

Accordingly, an object of the present invention is to provide a cleaning device which enables a lubricant to serve a longer time and which eliminates or suppresses problems such as omission of image and generation of noise, while reducing design restrictions, as well as a process cartridge and an image forming apparatus using such a cleaning device.

To this end, according to the present invention, there is provided a cleaning device for an electrophotography, comprising: a cleaning blade having an edge slidably contactable with an image carrier to remove foreign matters remaining on the surface of the image carrier, thereby cleaning said surface; wherein a lubricant including indefinite-form lubricant particles has been applied to zones on the edge of the cleaning blade near both longitudinal ends of the cleaning blade and a lubricant including spherical lubricant particles has been applied to the zone on the edge of the cleaning blade between the zones to which the lubricant including indefinite-form lubricant particles has been applied.

The invention also provides a process cartridge having the cleaning device stated above, and an image forming apparatus incorporating such a process cartridge.

The above and other objects, features and advantages of the present invention will become clear from the following description of the preferred embodiments when the same is read in conjunction with the accompanying drawings.

DESCRIPTION OF THE PREFERRED EMBODIMENTS

Preferred embodiments of the present invention will be described with reference to the drawings.

<First Embodiment of the Invention>

Figure 1:
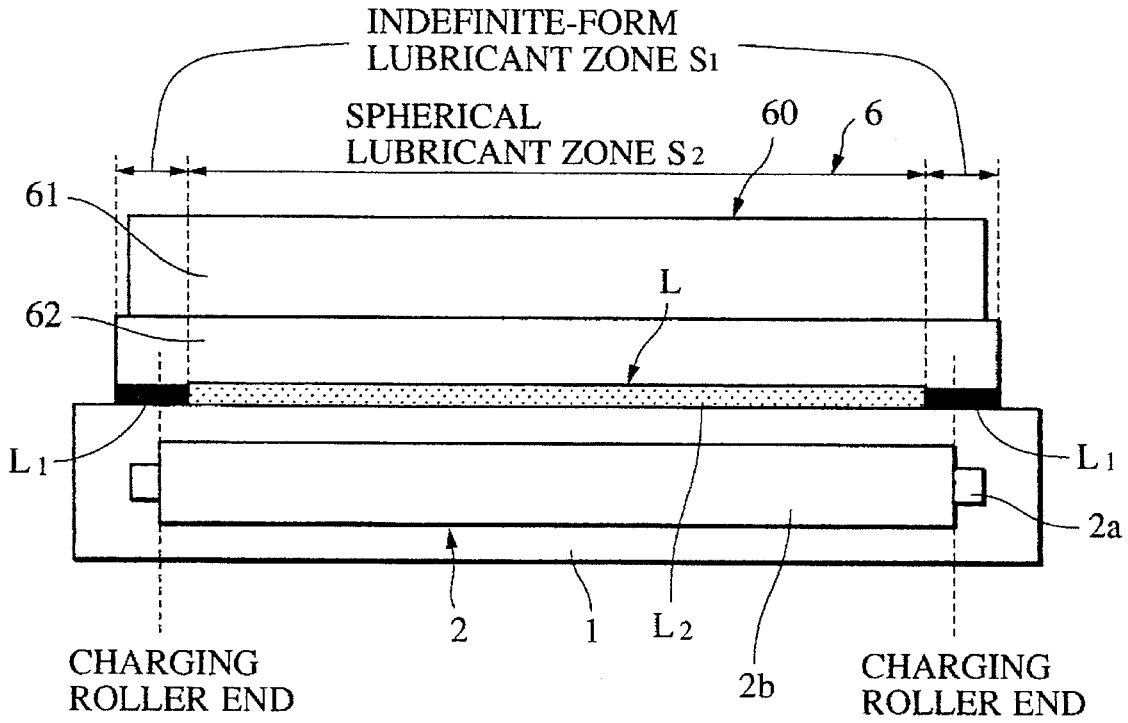
FIG. 1 is a top plan view of part of an image forming apparatus, showing particularly a cleaning device in accordance with a first embodiment, a photosensitive drum, and a charging roller.
Figure 2:
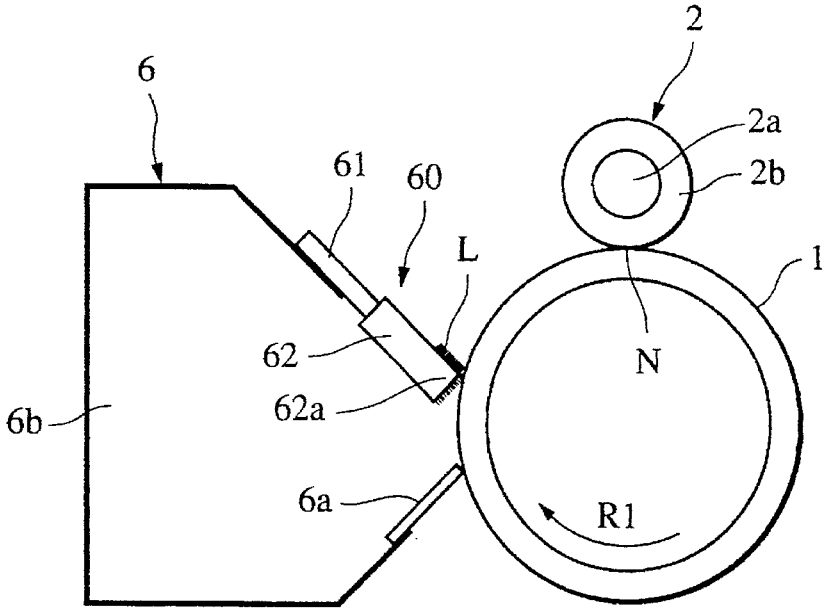
FIG. 2 is a cross-sectional view of the cleaning device, photosensitive drum, and the charging roller taken along a plane perpendicular to the axis of the photosensitive drum.

FIG. 1 is a top, plan view of a first embodiment of the cleaning device 6 in accordance with the present invention, showing also an image carrier 1 and a charging member 2. More specifically, FIG. 1 shows the cleaning device 6, image carrier 1, and the charging member 2 along their axes which extend from the left to the right as viewed in this Figure. FIG. 2 shows a cross-section taken along a plane perpendicular to these axes. Among these components shown in FIGS. 1 and 2, at least the cleaning device 6 is in a fresh state, i.e., in a state just before being put to use.

The image carrier 1 in the illustrated embodiment is a generally cylindrical electrophotographic photosensitive member (referred to as "photosensitive drum") comprised of a conductive aluminum substrate and a photosensitive surface layer formed on the substrate surface from OPC. The photosensitive drum 1 is adapted to be driven rotationally in the direction of an arrow R1.

The charging member 2 is a roller-shaped member (referred to as "charging roller") comprised of a metallic core member **2*a* clad with an elastic member. The charging roller 2 is mounted so as to be positioned on the upper side of the photosensitive drum 1 such that its axis extends in parallel with the axis of the photosensitive drum 1. The metallic core member 2*a* is urged at each end by urging members (not shown) towards the photosensitive drum 1, so that a charging nip N of a predetermined width is formed between the surface of the photosensitive drum 1 and the charging roller 2 along their generating lines. The metallic core 2*a* of the charging roller is connected to an electrical power supply which is not shown. As the photosensitive drum 1 rotates in the direction of the arrow R1, the charging roller 2 is fictionally, driven by the photosensitive drum 1 so that a charging voltage is imposed by the power supply on the charging roller 2, whereby the surface of the photosensitive drum 1** is uniformly charged to a predetermined potential.

The cleaning device 6 of the present invention has a cleaning blade 60, a receiving sheet **6*a* (referred to also as an "anti-blowing" member), and a cleaning vessel 6*b***.

The cleaning blade 60 has, for example, a supporting metal sheet 61 and a rubber member 62. The supporting metal sheet 61 is fixed at its base end to the cleaning vessel **6*b* while the free end thereof carries the rubber member 62 in the form of a tip attached thereto. The supporting metal sheet 61 and the rubber member 62 are elongated to span the length of the charging roller 22. Each edge 62*a* of the rubber member 62 is pressed onto the surface of the photosensitive drum 1 at a suitable level of pressure due to its resiliency and that of the supporting metal sheet 61. Urethane rubber and silicone rubber are used suitably but not exclusively as the rubber member 62**.

The receiving sheet 6a serves to prevent the residual toner scraped off the photosensitive drum 1 from being scattered out of the cleaning vessel 6b, and is formed of a member having a suitable level of resiliency such as, for example, a resin sheet such as of PET (polyethylene terephthalate). The receiving sheet 6a is fixed by, for example, an adhesive to the cleaning vessel 6b such that its free end lightly contacts the surface of the photosensitive drum 1.

In this embodiment, a lubricant L is applied to the edge 62a of the cleaning blade 60 over the entire length of the edge 62a. More specifically, two types of lubricants are used: a lubricant $L_1$ which is mainly constituted from indefinite-form particles (referred to as an "indefinite-form lubricant", composed or formed of hereinunder), and a lubricant $L_2$ which is mainly constituted from spherical particles (referred to as a "spherical lubricant", hereinunder), are applied to the edge 62a of the cleaning blade 60 in a specific pattern along the length of the edge 62a. Namely, as shown in FIG. 1, the indefinite-form lubricant $L_1$ is applied to each axial end zone of the edge 62a of the cleaning blade 60, whereas the spherical lubricant $L_2$ is applied to the zone intermediate the axial end zones where the lubricant $L_1$ is applied. The condition or state of adhesion of the lubricants $L_1$ and $L_2$ are differentiated such that, while the indefinite-form lubricant $L_1$ is densely applied, the spherical lubricant $L_2$ is applied only coarsely.

A description will now be given as to the definition of the foregoing terms "lubricant $L_1$ mainly formed of indefinite-form particles" and "lubricant $L_2$ mainly composed of spherical particles", in particular as to the meaning of "mainly composed of". A later-described concept "sphericity factor" K is used as the threshold or border between "indefinite form" and "spherical". More specifically, a lubricant composed of particles meeting the condition of $K \leqq 130$ is classified as being a spherical lubricant, whereas, when the condition is $130<K$, the lubricant is classified as being an indefinite-form lubricant.

According to the present invention, it is most effective and, hence, most preferred to apply a lubricant composed only of indefinite-form particles and a lubricant composed only of spherical particles in distinctive zones. For instance, even a small quantity of a spherical, particle-type lubricant mixed in a lubricant of indefinite form, particle-type tends to impair the advantage of the indefinite-form lubricant, i.e., retention on the edge 62a. As will be understood from a description which will be given later, the value of the above-mentioned sphericity factor linearly varies without any discontinuity or threshold, so that whether a particle of a lubricant is of "indefinite form" or "spherical" depends on the value at which the border between these two types of particles is set. The value is 130 in this embodiment as stated before. In accordance with the spirit of the present invention, therefore, the "lubricant $L_1$ mainly composed of indefinite-form particles" should be understood as being a lubricant which is preferably composed only of particles of indefinite form but does not exclude inclusion of a trace amount of spherical particles which may unavoidably be contained due to definition of the sphericity factor. Similarly, the "lubricant $L_2$ mainly composed of spherical particles" means not only a lubricant purely composed of spherical particles but also a lubricant which contain a trace amount of indefinite-form particles which may be contained due to linearity of the spherical factor values around the border value.

Features and uses of the lubricants $L_1$ and $L_2$ are described below.

The indefinite-form lubricant $L_1$ exhibits inferior fluidity because convexities and concavities of the indefinite-form particles interdigitate with each other. This type of lubricant therefore exhibits a smaller tendency of coming off from an object to which it is applied. The lubricant effect, however, is rather inferior as compared with the spherical lubricant, because of the inferiority in the fluidity. Practical examples of the indefinite-form lubricant $L_1$ are fine powders of a mean particle size of 0.5 to 1.0 μm prepared by crushing a material such as a fluororesin, e.g., ethylene tetrafluioride, vinylidene fluoride or the like, titanium oxide, strontium titanate, graphite fluoride, zinc stearate, and so forth. The application of the lubricant to the cleaning blade 60 is conducted by preparing a dispersion liquid by dispersing the fine powder in a volatile organic solvent. Examples of such organic solvent are: alcohols such as methanol, ethanol, or isopropynol; ketones such as acetone, methylethylketone, cyclohexane, and so forth; amides such as N,N-dimethylformamide, N, N-dimethylacetoamide, and so forth; sulfoxides such as dimethylsulfoxide and so forth; ethers such as tetrahydrofuran, dioxane, ethyleneglycol monomethylether and so forth; esters such as methyl acetate, ethyl acetate, and so forth; aliphatic hydrocarbon halides such as chloroform, methylene chloride, dichloroethylene, carbon tetrachloride, trichloroethylene, and so forth; and aromatic hydrocarbons such a benzene, toluene, xylene, ligroin, monochlorobenzene, dichlorobenzene, and so forth. Two types of dispersion liquid are prepared: namely, a dispersion liquid in which the indefinite-form lubricant L1 is dispersed and a dispersion liquid in which the spherical lubricant $L_2$ is dispersed, and these dispersion liquids are applied separately and sequentially. The application may be conducted by using a brush or the like, although it is preferred from the view point of controlling the amount of application and the zone of application to use an automatic applicator, e.g., a robot having an applicator portion capable of sucking and applying the dispersion liquid at a predetermined rate and an actuator, which actuated in accordance with a program. A too small particle size of the lubricant L undesirably enhances aggregation so as to increase the proportion of secondary or higher aggregate particles, with the result that dispersion into the solvent is impaired to hamper the handling. Conversely, a too large particle size hampers aggregation so as to reduce adhesion to the cleaning blade. In addition, when lubricant particles greater than the toner particle are present in the vicinity of the edge 62a, the toner particles may fail to be scraped off by the cleaning blade 60.

Spherical lubricant $L_2$ exhibits high fluidity and, hence, a high lubricating effect because of smoothness of the particle surface. This type of lubricant, however, is liable to come off from the object to which it has been applied. Practical examples of the spherical lubricant $L_2$ are fine particles prepared by, for example, a polymerization process from a silicone resin, an acrylic resin, an ethylene acrylic resin or the like to have a mean particle size typically ranging from 0.5 μm to 10 μm. The application of this type of lubricant to the surface of the cleaning blade 60 may be done in the same way as that for the indefinite-form particles. The preferred range of particle size of this type of lubricant $L_2$ is determined for the same reasons as those for the preferred range of particle size of the indefinite-form lubricant $L_1$.

In the present invention, the classification of the lubricant L into the indefinite-form lubricant $L_1$ and the spherical lubricant $L_2$ is made by drawing a border line of the value of the sphericity factor K, which is defined as follows:

Spherical factor K={(particle circumferential length)2×100)/(particle projection area×4π)

The sphericity factor K being 100 indicates a perfect sphere.

According to the present invention, whether the form is indefinite or spherical is determined based on the value of the sphericity factor K, which is defined by the equation shown above.

Figure 3:
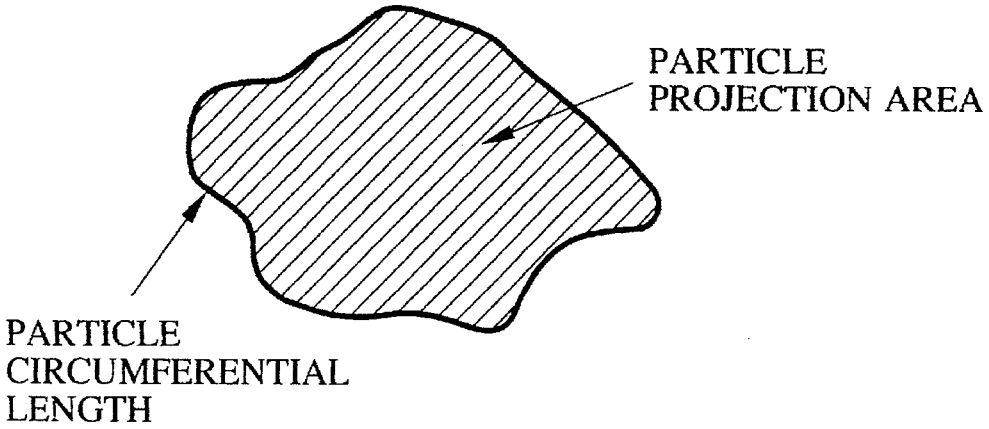
FIG. 3 is an illustration of parameters of the shape of a lubricant particle.

FIG. 3 illustrates the parameters of the above-mentioned equation. More specifically, FIG. 3 is an illustration of a typical example of a particle configuration. The measurement of the parameters was conducted, for example, by obtaining image information through a scanning electron microscope on 30 sample particles of the lubricant L selected at random, delivering the information to an image analyzer through an interface, and analyzing the image information by the image analyzer to determine the values of the parameters.

The sphericity factor K as measured on a spherical lubricant $L_2$ of silicon resin having a mean particle size of 2 μm was measured to be about 120. Based on this measurement result and taking into account particle size fluctuation, according to the present invention, lubricants having a sphericity factor values of 130 or less are sorted to be "spherical", whereas lubricants having sphericity factor values exceeding 130 are sorted to be "indefinite-form" lubricants.

According to the present invention, the indefinite-form lubricant $L_1$ and the spherical lubricant $L_2$ are applied to different and separate zones on the edge of the cleaning blade. Namely, the indefinite-form lubricant $L_1$ is applied to indefinite-form lubricant zones $S_1$ (referred to as "zone $S_1$", herinunder), while the spherical lubricant $L_2$ is applied to a spherical lubricant zone $S_2$ (referred to as "zone $S_2$", hereinafter). More specifically, the indefinite-form lubricant $L_1$ which maintains the lubrication effect for a long time is applied only to the zones $S_1$ where turning over of the cleaning blade is easily triggered, whereas the spherical lubricant $L_2$ is applied to the remainder zone $S_2$ in order to suppress generation of noise in the breaking-in period of the cleaning blade, i.e., in the initial period of use of the cleaning blade before toner and other matter serving as lubricants are accumulated of the cleaning blade. Thus, different lubricants are used in different zones so as to meet different lubricating requirements peculiar to the respective zones. The selective use of different lubricants in different zones offers the following advantages.

[Suppression of Noise in Breaking-In of Cleaning Blade]

Application of the indefinite-form lubricant L1 alone over the entire length of the edge 62*a* of the cleaning blade 60 tends to cause generation of noise in the breaking-in period of the cleaning blade. This is because the indefinite-form lubricant $L_1$ is rather inferior in the lubrication effect so a comparatively large frictional force is developed between the cleaning blade 60 and the photosensitive drum 1 so as to cause minute vibrations of the whole cleaning blade 60. This problem is serious particularly when the image forming apparatus is used at a high temperature. A higher temperature reduces the rigidity or stiffness of the cleaning blade 60 so as to increase the nip width of the cleaning blade edge 62*a*, and such an increase in the nip width is considered to be the cause of increase in the frictional force. The term "nip width", as in cases of other "nips" which will be mentioned later, is used to mean the width of the linear area where the photosensitive drum 1 is contacted by the blade edge 62*a* under pressure, as measured in the direction of rotation of the drum 1. In general, the noise in the breaking-in period progressively decreases and becomes unnoticeable after about 10 cycles of image formation in terms of the number of the copies or prints produced. Presumably, during production of copies or prints, dust formed of the material ground from the photosensitive layer as a result of friction with the cleaning blade 60, i.e., fine powder of the photosensitive material, is progressively accumulated in the region where the cleaning blade 60 contacts the photosensitive drum 1, specifically in the region near the edge 62*a* of the cleaning blade 60, so as to start to serve as a lubricant. It is therefore possible to present generation of noise in the period of breaking-in of the cleaning blade before the accumulation of fine powder of the photosensitive material, by applying the spherical lubricant to zone $S_2$ which spans almost all of the length of the cleaning blade 60 and which exhibits a small tendency of triggering the turn-over of the cleaning blade as compared with the zones $S_1$ which are on both end portions of the blade.

[Prevention of Turn-Over of Blade (Long-lasting lubrication effect)]

The indefinite-form lubricant $L_1$, by virtue of its small tendency of coming off the blade, stably maintains its lubrication effect for a long time. This should be contrasted to the spherical lubricant $L_2$ which easily comes off the cleaning blade 60 and falls into the cleaning vessel, serving for only a short period. Thus, if the spherical lubricant $L_2$ alone is used, the lubrication after the rapid extinction of the lubricant relies solely on the accumulated matter such as the toner and the fine powder ground from the photosensitive layer. This means that the lubrication effect may largely vary depending on the results of collection of the toner and other matter. Consequently, the frictional force may increase if the rate of collection of such matter is extremely reduced. A local increase in the friction also may occur in a region where the collected matter has been released or scattered away from the edge 62*a* due to, for example, vibration of the cleaning blade. Such a local increase in the friction may cause a local wear of the blade edge material and, moreover, may trigger turnover of the cleaning blade 60. Turning-over of the blade, however, takes place only when the ambient air temperature is high, e.g., 30° C. or higher, because at such a high temperature the blade rigidity is reduced to cause an increase in the nip width and, hence, of the frictional force. In the described embodiment of the present invention, therefore, the indefinite-form lubricant $L_1$, which exhibits small tendency of coming off the blade edge 62*a*, is applied to the zones $S_1$ where turning-over of the blade is liable to be triggered. The lubricant $L_1$ is present on such zones $S_1$ on the blade edge 62*a* so as to maintain appreciable lubrication effect for a long time, thus greatly suppressing the risk of blade turn-over despite any reduction in the amount of matter collected on the blade edge 62*a*.

In the illustrated embodiment of the present invention, the zones $S_1$ where the blade turn-over is liable to occur are the axial zones on the blade edge which correspond to the portions of the photosensitive drum 1 contactable with both axial end portions of the charging roller 2. In general, both axial end portions of the charging roller 2 have a large gradient along the axis. The conditions of the electric discharge at these both axial end portions are therefore different from those in the major axial central portion of the charging roller 2. More specifically, greater discharge current tends to appear at these axial end portions than at the axially central portion of the charging roller 2. Consequently, the surface of the photosensitive drum 1 tends to be locally deteriorated by the large discharge currents and, hence, roughened to increase the friction specifically at the portions thereof adjacent to both axial end portions of the charging roller. Thus, a specifically large amount of friction is developed between the roughened portions of the photosensitive drum 1 and the cleaning blade 60, allowing local rapid wear or omission of blade edge material and further posing a risk of triggering turn-over of the blade. In the illustrated embodiment of the present invention, therefore, the indefinite-form lubricant $L_1$ which exhibits a smaller tendency of coming off the blade is applied to the zones $S_1$ which correspond to both axial ends of the charging roller 60. This lubricant $L_1$ is retained for a long time despite any vibration of the cleaning blade caused by the enhanced friction at these zones $S_1$, thus offering a long-lasting lubrication effect, while preventing turn-over of the cleaning blade. In the meantime, the spherical lubricant $L_2$ applied to the central zone $S_2$ which spans a substantial portion of the overall length of the cleaning blade 60 satisfactorily suppresses generation of noise in the period of running-in of the cleaning blade. The inventors have confirmed that generation of noise in the breaking-in period is materially eliminated when the zone $S_2$ to which the spherical lubricant $L_2$ is applied spans at least 60 % of the overall axial length of the cleaning blade 60.

Figure 4:
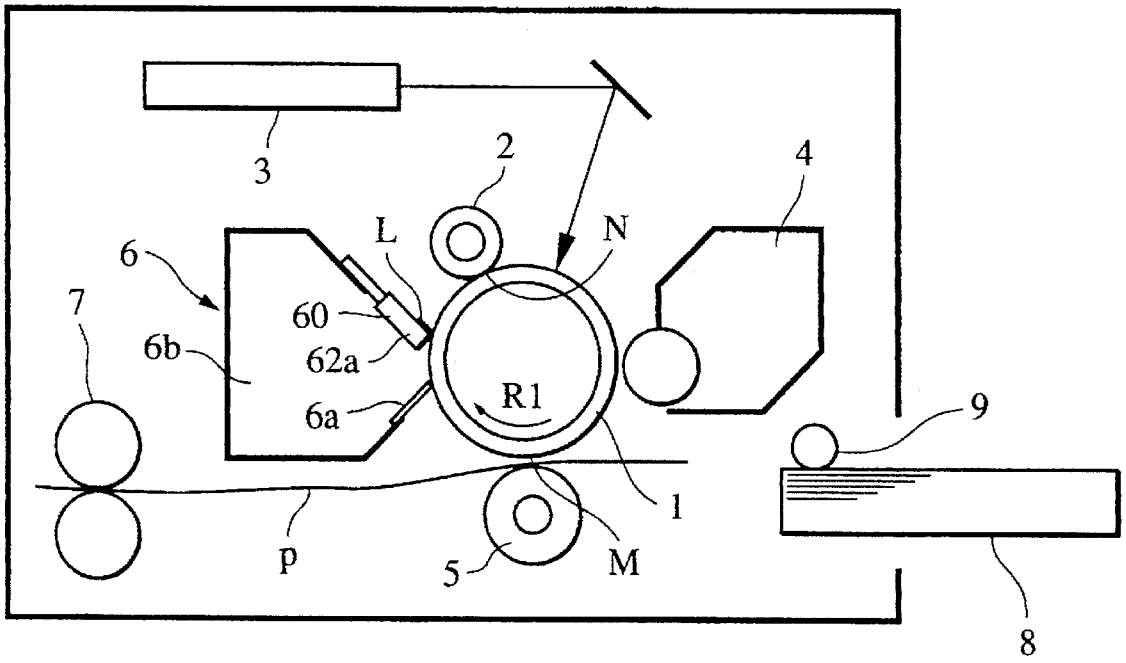
FIG. 4 is a diagrammatic longitudinal sectional view of an image forming apparatus in accordance with the first embodiment of the present invention.

FIG. 4 is a sectional view schematically showing an embodiment of the image forming apparatus incorporating the cleaning device 6 described above. In this Figure, the same reference characters as those used in FIGS. 1 and 2 are used to denote the same or equivalent components. A detailed description of such components is therefore omitted. Referring to FIG. 4, the surface of the photosensitive drum 2 is uniformly charged by the charging roller 2 in accordance with the rotation of the drum 1. The drum surface is then exposed to a laser light beam from an exposure device 3, so that an electrostatic latent image is formed on the surface of the photosensitive drum. The electrostatic latent image is developed by a developing device 4 so as to become a visible toner image which is then transferred o a transfer member P by the operation of a transfer device having a transfer roller 5. The transfer roller 5 is pressed onto the surface of the photosensitive drum 1 at a suitable level of contact pressure so as to form a linear belt-like transfer nip M between itself and the surface of the photosensitive drum 1. The transfer of the toner image to the transfer member P is conducted while the transfer member is moved through the transfer nip M, by the effect of a transfer voltage which is applied to the transfer roller 5. The transfer member P has been fed at a predetermined timing from a sheet feed cassette 8 by the operation of a sheet feed roller 9. The transfer member P carrying the toner image is made to pass through a fixing device 7 which applies pressure and heat so as to fix the toner image to the member P. The sheet member P carrying the image fixed thereon is then ejected from the apparatus. The portion of the surface of the photosensitive drum 1 from which the toner image has been transferred is cleaned by the cleaning device 6 which removes any residual toner, and the cleaned surface of the photosensitive drum 1 is subjected to the next image forming cycle.

Figure 5:
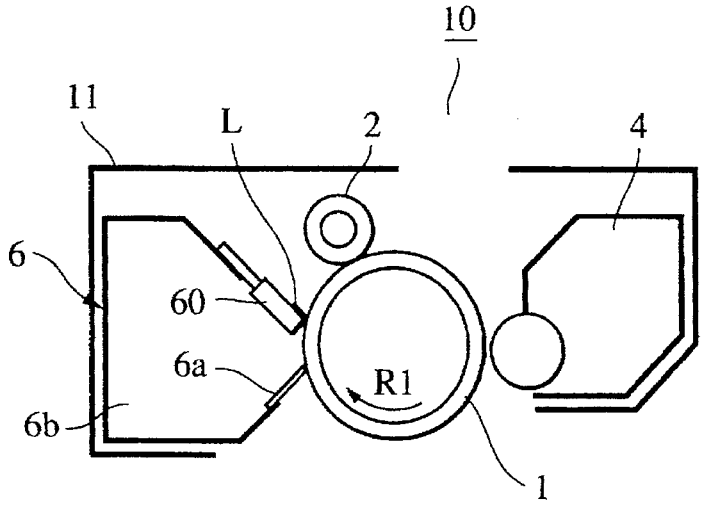
FIG. 5 is a diagrammatic longitudinal sectional view of a process cartridge in accordance with the first embodiment of the present invention.

FIG. 5 is a longitudinal sectional view of a process cartridge 10 in which the cleaning device 6 and the photosensitive drum 1 which are described in connection with FIGS. 1 and 2 are assembled together in a cartridge casing 11 which also encases the charging roller 2 and the developing device 4 integrally therewith. The process cartridge 10 thus assembled is detachably mounted in the main structure (not shown) of an image forming apparatus so as to be exchanged as desired. Namely, the process cartridge 10 on the image forming apparatus is replaced with a new process cartridge 10 when its service terminates due to exhaustion of the developer, i.e., toner, in the developing device 4 of this process cartridge. The process cartridge 10 advantageously eliminates the necessity of any maintenance service until the toner in the developing unit 4 is consumed, while offering the described advantages brought about by the cleaning device 6.

An experiment was conducted to compare the first embodiment with comparative examples, for the purpose of confirming the advantages offered by the first embodiment. The image forming apparatus shown in FIG. 4 was employed in this experiment.

[Conditions of Experiments]

(Conditions Common to Embodiment and Comparative Examples)

Environmental conditions:

air temperature 32° C., humidity 85 %

Endurance mode:

An image consisting of characters having a character printing ratio of 3% was formed on successive recording paper sheets. The image forming apparatus was manually vibrated after each 250 sheets of image printing, in order to create a severe operating condition which promotes falling of the lubricant L, toner particles and other matter from the edge 62*a* of the cleaning blade 60.

Comparative Example 1

Fine particles of carbon fluoride (mean particle size 2 μm) as the indefinite-form lubricant $L_1$ was dispersed in isopropylether at a concentration of 10 wt%, and the solution thus prepared was applied to the edge 62*a* of the cleaning blade 60 over the entire length of the blade 60 at a width of 1 mm.

Comparative Example 2

Fine particles of silicone resin (mean particle size 0.8 μm) as the spherical lubricant $L_2$ was dispersed in isopropylether at a concentration of 10 wt%, and the solution thus prepared was applied to the edge 62*a* of the cleaning blade 60 over the entire length of the blade 60 at a width of 1 mm.

Example of First Embodiment

Fine particles of carbon fluoride (mean particle size 2 μm) as the indefinite-form lubricant $L_1$ was dispersed in isopropylether at a concentration of 10 wt%, and the solution thus prepared was applied to edge 62*a* at 1 mm width, specifically to both zones $S_1$ of 15 mm length defined at both longitudinal end portions of the blade 60. At the same time, fine particles of silicone resin (mean particle size 0.8 μm) as the spherical lubricant $L_2$ was dispersed in isopropylether at a concentration of 10 wt%, and the solution thus prepared was applied to the edge 62*a* at 1 mm width, specifically to the central zone $S_2$ which spans 210 mm in the longitudinal direction of the blade.

[Results]

Comparative Example 1

Noise was generated shortly after the start of operation, during printing on second to eighth sheets. As to endurance, printing was executed safely on consecutive 6000 sheets.

Comparative Example 2

Turn-over of the cleaning blade occurred after printing on 1800 sheets, although noise generation in the beginning period was observed.

Example of First Embodiment

Printing was safely executed on consecutive 6000 sheets, without generation of noise in the beginning period.

Thus, the described first embodiment of the present invention provides a cleaning device 6, a process cartridge 10, and an image forming apparatus which is free from the problems of noise generation in the breaking-in period and turn-over of the cleaning blade.

<Second Embodiment of the Invention>

Figure 6:
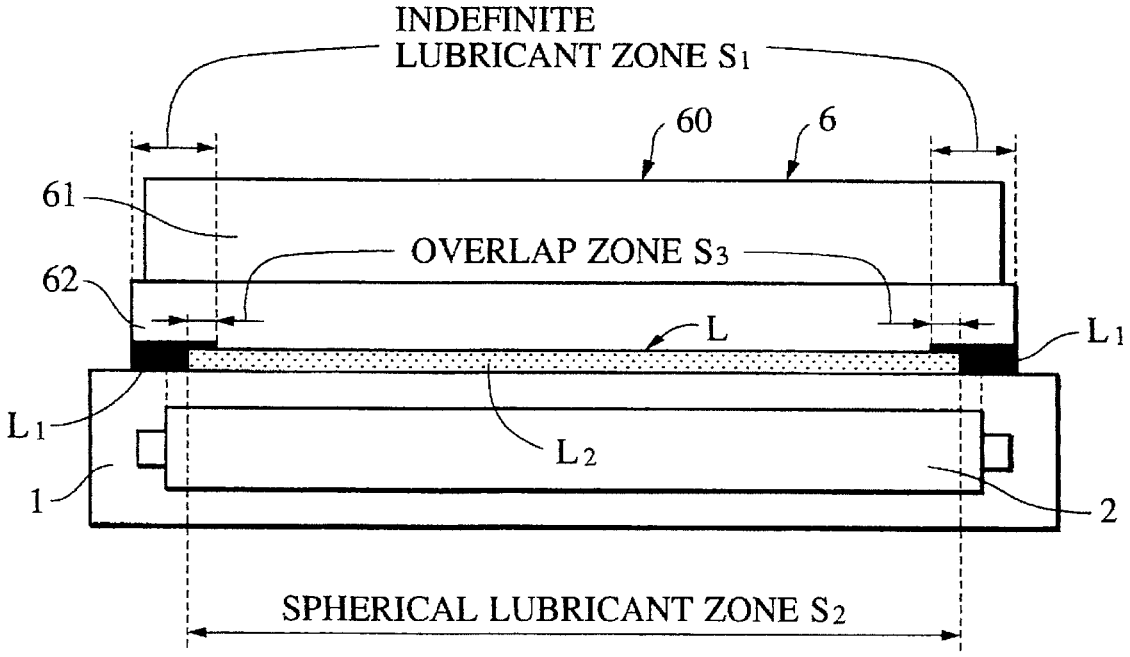
FIG. 6 is a top plan view of a cleaning device in accordance with a second embodiment, showing also a photosensitive drum and a charging roller.

FIG. 6 shows, in a top plan view, a cleaning device 6 in accordance with a second embodiment, together with an image carrier 1 and a charging roller 2 used in combination therewith. The cleaning device 6, image carrier 1 and the charging roller 2 have lengths and positional relationships as shown in this Figure in the direction of their lengths which is to the left and right as viewed in the Figure. Thus, the arrangement as viewed in a cross-sectional plane perpendicular to the longitudinal direction is the same as that shown in FIG. 2. At least the cleaning device 6 is in fresh state, i.e., just being put to use.

The pattern of application of the lubricant to the cleaning blade 60 is similar to that in the first embodiment. Namely, the indefinite-form lubricant $L_1$ is applied to the zones corresponding to both axial ends of the charging roller 2, while the remainder central zone is lubricated by spherical lubricant $L_2$ applied thereto. The compositions of these lubricants $L_1$, $L_2$ and the method of application of these lubricants may be the same as those in the first embodiment. In this case, however, an overlap zone in which these two types of lubricants are applied commonly is formed at each border between the zones of the indefinite-form lubricant $L_1$ and spherical lubricant $L_2$, over a predetermined width as measured in the direction of axis of the image carrier. The provision of such overlapping zones is intended for the following purposes.

Application of the two types of lubricants, i.e. the, indefinite-form lubricant $L_1$ and the spherical lubricant $L_2$, is usually conducted by preparing solutions of these lubricants in organic solvents, and then applying the solutions by suitable means such as applicators. Due to the fluidity of the solutions, the lengths of the zones of respective lubricant solutions inevitably fluctuate, depending on factors such as precision of the applicators, lateral spreading of the solutions, and so forth. Therefore, in order that the zone $S_1$ in which the indefinite-form lubricant $L_1$ is applied and the zone $S_2$ in which the spherical lubricant $L_2$ is applied precisely join each other at the boundary as in the first embodiment shown in FIG. 1, it is required to strictly control the application conditions such as the precision of the applicator, rate of application, viscosity of the solution, rate of drying, and so forth. In addition, if the application has been done unsuccessfully such as to leave a vacant zone where no lubricant exists between the zones of different lubricants $L_1$ and $L_2$, friction is locally increased at the vacant zone so as to cause troubles such as local wear of the blade edge 62*a*, local omission of the blade edge material, and triggering of blade turn-over. In order to increase the throughput in mass-production by allowing a greater margin, it is preferred to provide an overlap zone where two types of lubricants are applied in overlapping manner, so as to avoid generation of vacant zone devoid of lubricant, thus ensuring that the cleaning blade is lubricated over its entire length.

The length of the overlap zone as measured in the longitudinal direction of the blade is determined to be small but large enough to tolerate fluctuations in the lengths of the zones of the two types of lubricants. Considering the construction of the apparatus and the nature of the solutions presently available, the length should be 1 mm at the smallest.

An image forming apparatus substantially the same as that shown in FIG. 4 illustrating the first embodiment can be obtained by using the cleaning device of this embodiment.

A process cartridge similar to the process cartridge 10 of the first embodiment described in connection with FIG. 5 can be obtained by integrally mounting this cleaning device 6 in a cartridge casing together with the charging roller and the developing device. Such a process cartridge offers an additional advantage in that the necessity of maintenance work is substantially eliminated until the life of the cartridge expires due to exhaustion of the toner in the developing device.

Thus, the second embodiment also provides a cleaning device 6, process cartridge, and an image forming apparatus, which can stably operate for a long time without any risk of turn-over of the cleaning blade and without generation of noise in the initial period of breaking-in of the cleaning device.

<Third Embodiment of the Invention>

Figure 7:
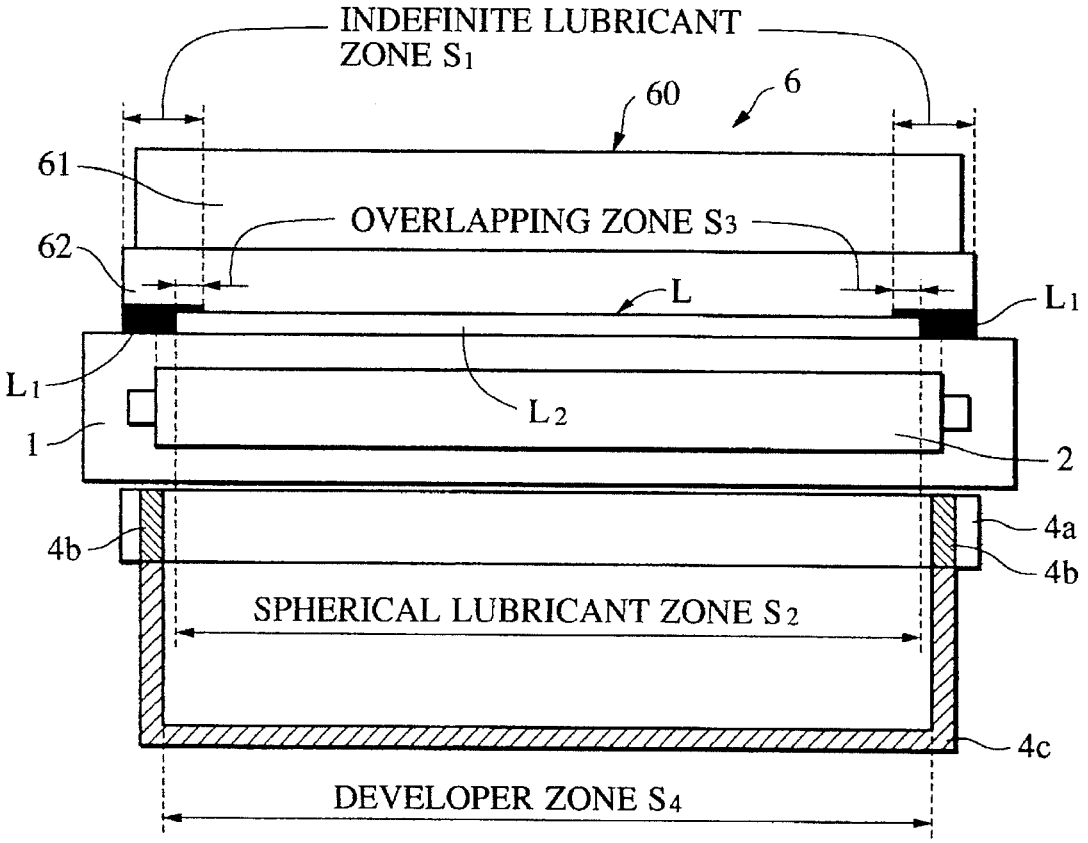
FIG. 7 is a top plan view of a cleaning device in accordance with a third embodiment, showing also a photosensitive drum and a charging roller.
Figure 8:
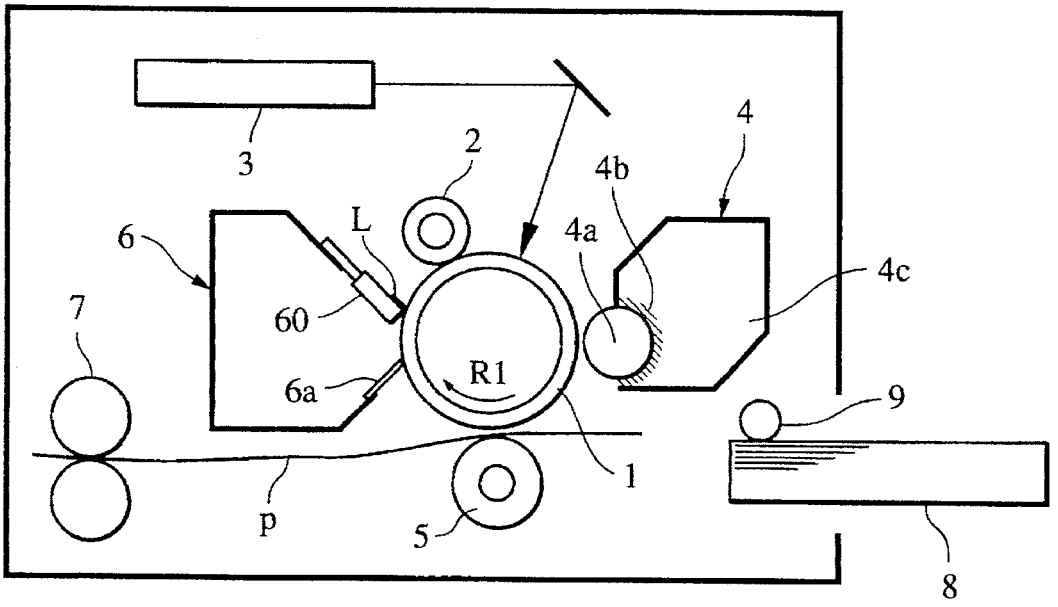
FIG. 8 is a diagrammatic longitudinal sectional view of an image forming apparatus in accordance with the third embodiment of the present invention.

FIG. 7 is a top, plan view of a cleaning device 6 in accordance with a third embodiment of the invention and an image carrier 1 and a charging roller 2 used in combination with the cleaning device. The cleaning device 6, image carrier 1 and the charging roller 2 are extended in the right and left directions as viewed in this Figure and are positioned in relation to one another in the illustrated manner. FIG. 8 is a longitudinal sectional view schematically showing the construction of an image forming apparatus in accordance with the present invention. In the assembly shown in FIG. 7, at least the cleaning device 6 is in fresh state, i.e., in a state before use.

Referring to FIG. 7, as in the second embodiment described before, an indefinite-form lubricant $L_1$ and a spherical lubricant $L_2$ are respectively applied to the zones $S_1$ and $S_2$ on the edge 62*a* of the cleaning blade, and an overlap zone $S_3$ of a predetermined length is formed at each border between the zones $S_1$ and $S_2$. The third embodiment is characterized in that the overlap zones $S_3$ are positioned within the span of a zone $S_4$ over which a developer is supplied by the developing device 4. The developing device 4 has a developer container 4*c* (see FIG. 8) having a developer outlet. Developer leakage prevention members 4*b* such as of felt are disposed at both longitudinal ends of the developer outlet in close contact with a rotatable developer roller (developer carrier) 4*a* so as to prevent the developer in the container 4*c* from leaking outside. When this type of developing device 4 is used, the developer supply zone $S_4$ is defined as the distance between the opposing faces of the developer leakage prevention members 4*b* which are disposed at both longitudinal ends of the developer container.

A description will now be given as to the reason why the overlap zone $S_3$ is disposed within the span of the developer supply zone $S_4$.

A greater size of the overlap zone $S_3$ provides a greater margin for the precision of application of the lubricants, thus affording a greater ease of mass-production of the cleaning blade. The overlap zone $S_3$, however, has such a property that lubricant L is less liable to come off the blade due to the presence of the indefinite-form lubricant $L_1$ than in the zone $S_2$ where the spherical lubricant $L_2$ alone is applied, but is more liable to come off than in the zone $S_1$ where the indefinite-form lubricant alone is used.

Figure 9:
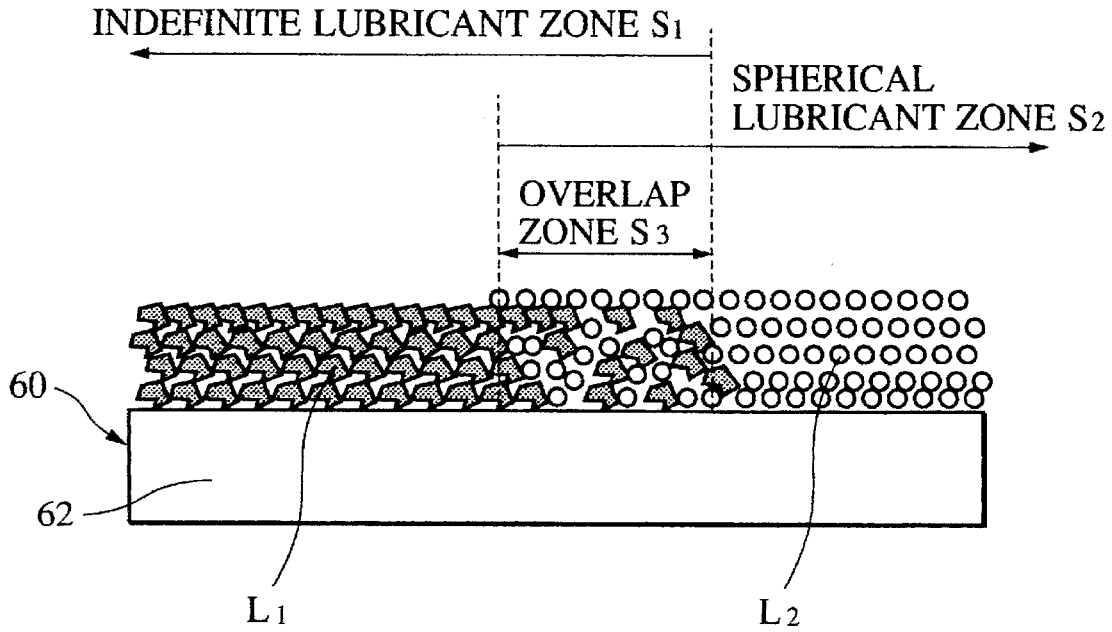
FIG. 9 is a sectional view showing zones where two types of lubricants are applied in overlapping manner.

FIG. 9 shows is a sectional view of the overlap zone $S_3$ taken along a plane parallel to the axis of the cleaning blade 60. The indefinite-form lubricant $L_1$ is applied first and then the spherical lubricant $L_2$ is applied, so that the spherical lubricant particles of the lubricant $L_2$ are present between the indefinite-form particles of the lubricant $L_1$, so as to weaken the cohesion of the indefinite-form particles of the lubricant $L_1$. This poses a risk that the lubricant L may come off the cleaning blade 60 locally at the overlap zone S3 so as to impair the overall lubricating effect. However, the present inventors have found that the above-mentioned risk does not lead to critical problems such as local rapid wear of the cleaning blade edge 62*a*, omission of the edge material, or turn-over of the cleaning blade, unless the overlap zone $S_3$ is positioned in the region of the surface of the photosensitive drum 1 corresponding to both axial ends of the charging roller 2 where the photosensitive surface of the drum exhibits specifically high friction coefficient as stated before. Thus, the presence of the overlap zone $S_3$ outside the above-mentioned region does not cause any critical rise in the friction and, hence, does not cause any practical problem.

Provided that the overlap zone $S_3$ is disposed within the developer supply zone $S_4$ where the developer is supplied from the developing device 4, residual toner and toner form the background fogging area are supplied to the overlap zone $S_3$ by way of the photosensitive drum 1 so as to compensate for the loss of lubricant from the overlap zone $S_3$, so that a lubrication effect large enough to prevent turn-over of the cleaning blade is maintained even if the overlap zone $S_3$ is positioned near the portions of the photosensitive drum surface which correspond to both axial ends of the charging roller 2. In this embodiment, therefore, the positions of the overlap zones $S_3$ can be determined with a greater margin or tolerance, contributing to a further improvement in the efficiency of mass-production.

As to the sequence of applications of two types of lubricants to the cleaning blade 60, it is preferred that the indefinite-form lubricant $L_1$ is applied first, followed by the application of the spherical lubricant $L_2$, because the radial region close to the cleaning blade 60 has a greater concentration of the indefinite-form lubricant $L_1$ so as to provide a greater adhesion to the cleaning blade 60.

Figure 10:
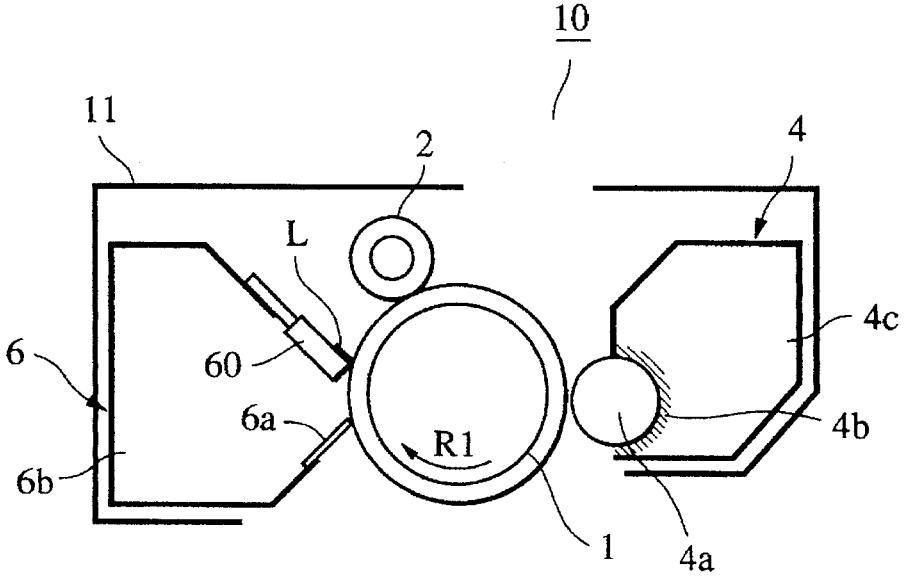
FIG. 10 is a diagrammatic longitudinal sectional view of a process cartridge in accordance with the third embodiment.
Figure 11:
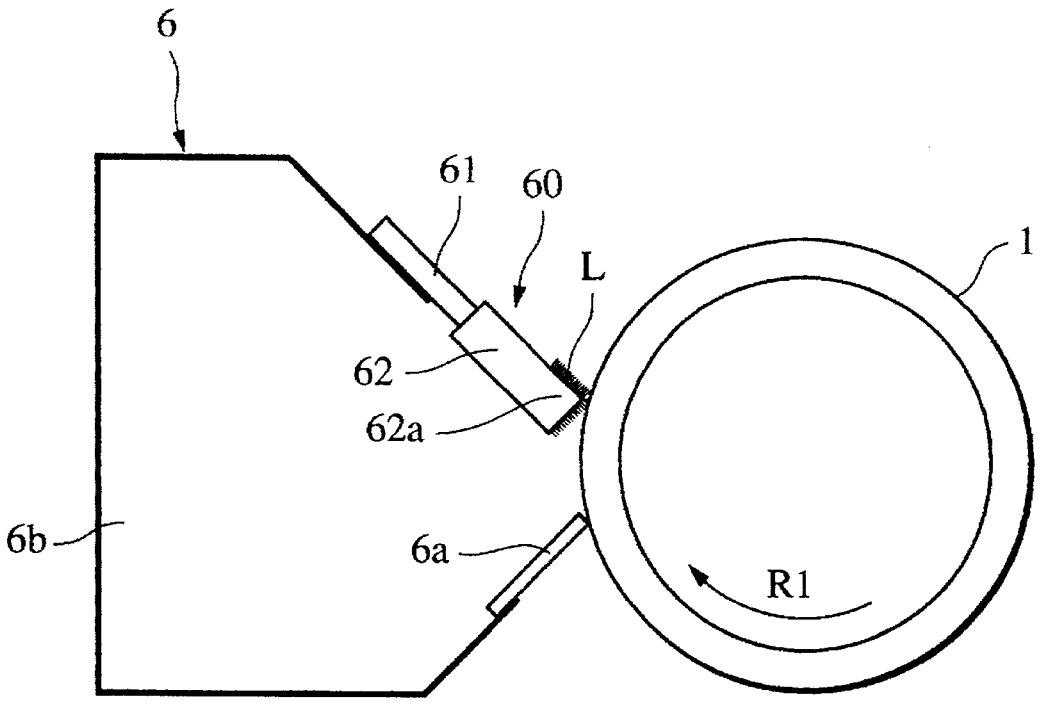
FIG. 11 is a longitudinal sectional view of a conventional cleaning device.

FIG. 10 is a longitudinal sectional view of a process cartridge 10 in which the cleaning device 6 explained before in connection with FIG. 7 is assembled together with the photosensitive drum 1 and the developing device 4 and also with the charging roller 2 to form a unitary structure which is encased in a cartridge casing 11. The process cartridge is exchangeable with a new process cartridge when the developer in the developing device 4 has been consumed. Thus, the process cartridge offers an advantage in that the necessity of the maintenance work is substantially eliminated during the service of the process cartridge, i.e., until the exhaustion of the toner in the developing device 4.

An experiment was conducted for the purpose of confirming the advantages offered by the third embodiment. The image forming apparatus shown in FIGS. 7 and 8 was employed in this experiment.

[Conditions of Experiments]

Environmental conditions:

air temperature 32.5° C., humidity 85%

Endurance mode:

An image consisting of characters having a character printing ratio of 3% was formed on successive recording paper sheets. The image forming apparatus was manually vibrated after each 250 sheets of image printing, in order to create a severe operating condition which promotes falling of the lubricant L, toner particles and other matter from the edge 62*a* of the cleaning blade 60.

Conditions of Application of Lubricant L:

Fine particles of carbon fluoride (mean particle size 2 μm) as the indefinite-form lubricant $L_1$ was dispersed in isopropylether at a concentration of 10 wt%, and the solution thus prepared was applied to edge 62*a* at 1 mm width, specifically to both zones $S_1$ of 15 mm length as measured from the respective longitudinal ends of the blade 60 which is 240 mm long. In the meantime, fine particles of silicone resin (mean particle size 0.8 μm) as the spherical lubricant $L_2$ was dispersed in isopropylether at a concentration of 10 wt%. After application of the indefinite-form lubricant L1 to the zones $S_2$, the solution thus prepared was applied to the edge 62*a* at 1 mm width, specifically to the central zone $S_2$ which spans 216 mm in the longitudinal direction of the blade, so that an overlap zone $S_3$ of where the spherical lubricant $L_2$ is superposed on the indefinite-form lubricant $L_1$ was formed over a length of 3 mm at each end of the central zone $S_2$. The charging roller 2 used had an axial length of 225 mm. Thus, the lengths of the respective zones were as follows:

Each of zones $S_1$ of indefinite-form lubricant $L_1$: 15 mm

Zone $S_2$ of spherical lubricant $L_2$: 216 mm

Overlap zone $S_3$: 3 mm

Developer supply zone $S_4$: 220 mm

In the test operation, no noise generation was observed in the breaking-in period and the printing was successfully performed on 6000 consecutive sheets without any problem, thus proving superior endurance.

Thus, the third embodiment provides an image forming apparatus or a process cartridge which is further suited to mass-production and which is free from the problems such as generation of noise in the period of breaking-in of the cleaning device and turn-over of the cleaning blade.

<Fourth Embodiment of the Invention>

Figure 12:
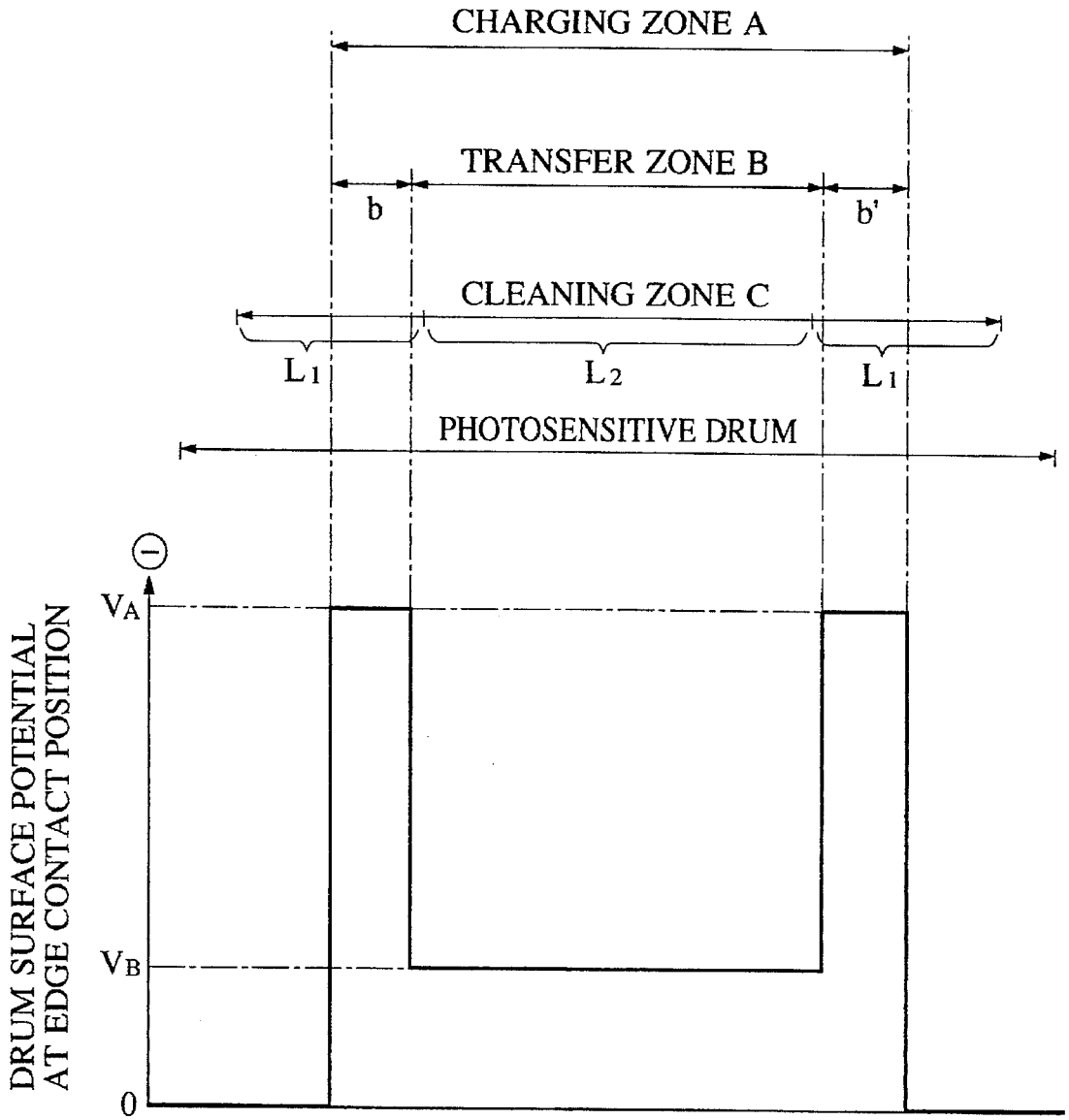
FIG. 12 is an illustration of a charging nip, transfer nip, blade edge, and the photosensitive drum surface along their lengths, in relation to the drum surface potential at the region where the blade edge contacts the photosensitive drum.

FIG. 12 shows a fourth embodiment of the present invention. More specifically, this Figure shows the relationship between the surface potential of the photosensitive drum 1 along the length of the drum 1 and the lengths and positions of the tree components arranged in contact with the surface of the photosensitive drum 1: namely, a charging roller 2 (see also FIG. 4), a transfer roller 5, and a cleaning blade 60. The lengths of these three components, however, are illustrated in terms of the lengths of a charging zone A, transfer zone B, and a cleaning zone C where the respective components actually contact the drum surface. The lengths of these zones are determined in relation to the length of the photosensitive drum so as to meet the condition of: Length of photosensitive drum>Length of cleaning zone C>Length of charging zone A>Length of transfer zone B. The surface potential of the photosensitive drum 1 is the potential developed along the linear area where the drum surface is contacted by the edge 62*a* of the cleaning blade 60. In the graph showing the surface potential, a higher level of the surface potential indicates a greater absolute value of the negative potential of the drum surface. The lengthwise dimensional relationships of these four components including the photosensitive drum is nothing particular but is commonly employed in various image forming apparatuses.

In operation of the image forming apparatus having the illustrated arrangement, the charging roller 2 uniformly charges the surface of the photosensitive drum 1 over the entire length of the charging zone A to a negative potential $V_A$. Then, a positive bias is applied by the transfer roller 5 over the entire length of the transfer zone B, so that the absolute value of the negative potential is reduced to $V_B$ in the transfer zone B. Consequently, a large difference in the potential are creased on the surface of the photosensitive drum 1 along the linear area where the blade edge 62*a* contacts the drum surface, between the zones "b", "b'" (potential $V_A$) which are within the charging zone A but outside the transfer zone B and other zones where the potential is "0 (zero)" or "$V_B$".

In the meantime, the potential of the edge 62*a* of the cleaning blade 60 tends to become substantially 0 (zero). Consequently, an electric field due to at least the potential difference ($V_A$–$V_B$) is formed between the zones "b", "b'" and the edge 62*a*, so that the lubricant L on the blade edge 62*a* tends to be electrostatically separated from the blade edge 62*a* so as to be delivered to the photosensitive drum 1 by the Coulomb force produced by the above-mentioned electric field. The portion of the blade edge 62*a* from which the lubricant L has been separated locally exhibits an increased coefficient of friction with the surface of the photosensitive drum 1, tending to trigger a turn-over of the blade.

In order to overcome this problem, the fourth embodiment of the present invention employs a specific pattern of application of lubricants. More specifically, indefinite-form lubricant $L_1$ is applied to the portions of the edge 62*a* of the cleaning blade 60 corresponding to the zones "b" and "b'" on the photosensitive drum, i.e., in both end regions of the edge 62*a* which spans the cleaning zone C, whereas a spherical lubricant $L_2$ is applied to the zone corresponding to the transfer zone B which is sandwiched between the above-mentioned zones "b" and "b'". It is to be noted, however, the borders between the zones of the lubricants $L_1$ and $L_2$ should be located within the transfer zone B.

This specific pattern of application of the lubricants $L_1$ and $L_2$ to the cleaning blade 60 offers a stable lubrication effect in the image forming arrangement as shown in FIG. 12.

The first to fourth embodiments described hereinbefore are intended to overcome the problem in regard to coming off of the lubricant L taking place at both longitudinal end portions of the edge 62*a* of the cleaning blade 60 due to mechanical action caused by friction or electrostatic action caused by an electric field. These embodiments are therefore effective particularly in such a type of image forming apparatus that is designed and constructed to exactly and correctly form an image with a toner (developer) in the central zone of the photosensitive drum using the axially mid-point on the photosensitive drum as a reference so that the transfer member P to which the image is transferred is fed to the axially central zone of the photosensitive drum 1. Namely, the described embodiments are particularly effective in image forming apparatuses of such a type that the transfer member P is fed into contact with the photosensitive member with the breadthwise center thereof aligned with the axially mid-position of the photosensitive drum 1.

There is another type of image forming system in which toner image is formed by using, as a reference, one longitudinal end of the photosensitive drum 1, so that a toner image is transferred to a transfer member P which is fed such that its one side edge is aligned with the above-mentioned reference. In this case, the end of the photosensitive drum 1 serving as the reference engages with the side edge of each of many transfer members P which are fed into contact with the photosensitive member, whereas the other end of the photosensitive member 1 engaged by the other side edge of the transfer member P only when the transfer member P has a large width as measured in the direction of axis of the photosensitive drum 1. Therefore, the end portion of the photosensitive drum 1 serving as the reference has an abundance of foreign matter such as residual toner which serve as the lubricant, whereas the other end of the photosensitive drum is almost free of such foreign matter. Consequently, a greater tendency for the lubricant L to come off the edge 62*a* of the cleaning blade 60 is observed at the longitudinal end zone of the blade edge 62*a* opposite to the end which faces the axial end of the photosensitive drum 1 used as the reference. It is therefore advisable that the indefinite-form lubricant $L_1$ is applied only to the longitudinal end zone of the blade edge 62*a* where the lubricant L tends to come off the blade edge 62*a*, so that lubrication effect can be maintained for a longer time. This means that a specifically notable effect is obtained when the indefinite-form lubricant $L_1$ is applied to the zone of the blade edge 62*a* corresponding to the end of the photosensitive drum opposite to the end used as the reference, and does not exclude application of the indefinite-form lubricant $L_1$ to the zone of the blade edge 62*a* adjacent to the end of the photosensitive drum 1 as the reference.

Thus, according to the spirit of the present invention, an indefinite-form lubricant $L_1$ is applied to an indefinite-form lubricant zone or zones $S_1$ defined along the length of the edge 62*a* of the cleaning blade where the lubricant L exhibits a greater tendency to come off the blade edge 62*a*, whereas a spherical lubricant $L_2$ is applied to the remainder zone serving as a spherical lubricant zone $S_2$ .

As has been discussed, image forming apparatuses have encountered a problem in that the lubricant applied to the edge of a cleaning blade contacting the image carrier surface tends to come off the blade edge, locally in the zones engageable with the portions of the image carrier surface contactable with both longitudinal ends of the charging member, due to local increase in the friction attributable to roughening of such portions of the image carrier surface caused by extraordinary electric discharge or due to a drastic change in the electrostatic potential appearing at such portions of the image carrier surface. According to the present invention, a lubricant mainly composed of indefinite-form lubricant particles which exhibit smaller tendency of separation from the blade edge is applied specifically to both longitudinal end zones of the blade edge when the roughening of the image carrier surface occurs at both end portions of the image carrier surface or, when the roughening or drastic change in potential takes place only at one axial end portion of the image carrier surface, to one end zone of the blade edge corresponding to such an axial end portion of the image carrier surface, whereby a stable lubrication effect is maintained over a long period of time.

Meanwhile, a lubricant mainly composed of spherical lubricant particles which provide superior lubricating effect is applied to the remainder zone on the blade edge, so that a sufficiently high lubricating effect is obtained to eliminate generation of noise and other problems such as turn-over of the cleaning blade particularly in the period of breaking-in of the cleaning device.

The zone to which the indefinite-form lubricant is applied and the zone to which the spherical lubricant is applied may partly overlap at the boundary therebetween. Such overlap zone provides a sufficiently large margin or tolerance in regard to the precision of applications of the two types of lubricants, thus making it possible to apply the lubricants over the entire length of the cleaning blade edge under a less strict control of the applying operations and application conditions, ensuring that problems such as generation of noise and turn-over of the cleaning blade are eliminated over the entire length of the cleaning blade.

The overlap zone is preferably located within the developer supply zone, because in such a case the reduction of the lubricating effect due to separation of the lubricant in the overlap zone is compensated for by the supply of the toner, i.e., developer, to this zone. This feature enables the overlap zone to be formed with a greater span, while affording a greater tolerance of condition for application of the lubricant, thus facilitating production of a cleaning device which is free from the problems such as generation of noise and turn-over of the cleaning blade.

The present invention also provides a process cartridge in which the above-described cleaning device is assembled integrally in a cartridge casing. The present invention prevents shortening of the life of the process cartridge which otherwise may occur due to the aforesaid problems occurring in the process cartridge.

Similarly, an image forming apparatus employing the above-described cleaning device can operate without suffering from any degradation in the product image which may be caused due to the problems occurring when the cleaning device of the present invention is not used.

What is claimed is:

1. A cleaning device for an electrophotographic apparatus including an image carrier comprising:

a cleaning blade having an edge slidably contactable with said image carrier to remove residual toner and foreign matter remaining on a surface of said image carrier, thereby cleaning said surface;

wherein a lubricant including indefinite-form lubricant particles has been applied to zones on the edge of said cleaning blade, the zones being near both longitudinal ends of said cleaning blade, and a lubricant including spherical lubricant particles has been applied to a zone on the edge of said cleaning blade between the zones to which said lubricant including indefinite-form lubricant particles has been applied.

2. A cleaning device according to claim 1, wherein said image carrier is an electrophotographic photosensitive member on which a toner image is to be formed.

3. A cleaning device according to claim 2, wherein said electrophotographic photosensitive member is chargeable by an electrode member contacted therewith, and the zones to which said lubricant including indefinite-form lubricant particles is applied are the zones corresponding to both longitudinal ends of said electrode member.

4. A cleaning device according to claim 1, wherein the zone to which said lubricant including spherical lubricant particles is applied partially overlaps the zones to which said lubricant including indefinite-form lubricant particles is applied.

5. A cleaning device according to claim 1, wherein each of said lubricants has a mean particle size ranging from 0.5 to 10 μ.

6. A cleaning device according to claim 5, wherein said indefinite-form lubricant particles have values of a sphericity factor exceeding 130, and said spherical lubricant particles have values of a sphericity factor not greater than 130.

7. A cleaning device for an electrophotographic apparatus including an image carrier comprising:

a cleaning blade having an edge slidably contactable with the surface of an electrophotographic photosensitive member on which a toner image is to be formed, so as to remove residual toner and foreign matter remaining on a surface of said electrophotographic photosensitive member;

wherein a lubricant including indefinite-form lubricant particles has been applied to zones on the edge of said cleaning blade, the zones being near both longitudinal ends of said cleaning blade having a span corresponding to an image forming zone on said electrophotographic photosensitive member and a lubricant including spherical lubricant particles has been applied to a zone on the edge of said cleaning blade between the zones to which said lubricant including indefinite-form lubricant particles has been applied.

8. A cleaning device according to claim 7, wherein said electrophotographic photosensitive member is chargeable by an electrode member contacted therewith, and the zones to which said lubricant including indefinite-form lubricant particles is applied are the zones corresponding to both longitudinal ends of said electrode member.

9. A cleaning device according to claim 7, wherein each of said lubricants has a mean particle size ranging from 0.5 to 10 μ.

10. A cleaning device according to claim 7, wherein said indefinite-form lubricant particles have values of a sphericity factor exceeding 130, and said spherical lubricant particles have values of a sphericity factor not greater than 130.

11. A process cartridge having a cleaning device for electrophotography and detachably mountable on a main structure of an apparatus, said process cartridge comprising:

an electrophotographic photosensitive member;

a cleaning device including a cleaning blade having an edge slidably contactable with the surface of said electrophotographic photosensitive member, so as to remove residual toner and foreign matter remaining on the surface of said electrophotographic photosensitive member, wherein a lubricant mainly composed of indefinite-form lubricant particles has been applied to zones on the edge of said cleaning blade near both longitudinal ends of said cleaning blade having a span corresponding to an image forming zone on said electrophotographic photosensitive member and a lubricant mainly composed of spherical lubricant particles has been applied to the zone on the edge of said cleaning blade between the zones to which said lubricant mainly composed of indefinite-form lubricant particles has been applied; and supporting means for supporting said photosensitive member and said cleaning device integrally with each other.

12. A process cartridge according to claim 11, further comprising an electrode member supported by said supporting means and contactable with said electrophotographic photosensitive member to serve as means for charging said electrophotographic photosensitive member, and the zones to which said lubricant including indefinite-form lubricant particles is applied are the zones corresponding to both longitudinal ends of said electrode member.

13. A process cartridge according to claim 11, wherein each of said lubricants has a mean particle size ranging from 0.5 to 10 μ.

14. A process cartridge according to claim 11, wherein said indefinite-form lubricant particles have values of a sphericity factor exceeding 130, and said spherical lubricant particles have values of a sphericity factor not greater than 130.

15. An image forming apparatus detachably mounting a process cartridge which has a cleaning device for cleaning an electrophotographic photosensitive member, said image forming apparatus comprising:

(a) the process cartridge comprising:

said electrophotographic photosensitive member;

an electrode member for charging said electrophotographic photosensitive member in contact therewith;

the cleaning device including a cleaning blade having an edge slidably contactable with the surface of said electrophotographic photosensitive member, so as to remove residual toner and foreign matter remaining on the surface of said electrophotographic photosensitive member, wherein a lubricant mainly composed of indefinite-form lubricant particles has been applied to zones on the edge of said cleaning blade near both longitudinal ends of said cleaning blade having a span corresponding to an image forming zone on said electrophotographic photosensitive member and a lubricant mainly composed of spherical lubricant particles has been applied to the zone on the edge of said cleaning blade between the zones to which said lubricant mainly composed of indefinite-form lubricant particles has been applied; and supporting means for supporting said photosensitive member and said cleaning device integrally with each other; and (b) transfer means which cooperates with said electrophotographic photosensitive member in forming therebetween a nip through which a toner image formed on said electrophotographic photosensitive member is transferred to a transfer medium, the length of said nip formed by said transfer medium at the time of image transfer being smaller than the length of the zone over which said electrode member contacts said electrophotographic photosensitive member.

16. An image forming apparatus according to claim 15, wherein each of said lubricants has a mean particle size ranging from 0.5 to 10 μ.

17. An image forming apparatus according to claim 15, wherein said indefinite-form lubricant particles spherical lubricant particles have values of a sphericity factor not greater than 130.

* * * * *

UNITED STATES PATENT AND TRADEMARK OFFICE

CERTIFICATE OF CORRECTION

PATENT NO. : 5,646,718

DATED : July 8, 1997

INVENTOR(S) : SUWA ET AL.

It is certified that error appears in the above-identified patent and that said Letters Patent is hereby corrected as shown below:

Column 1

Line 11, "alsao" should read --also--.

Column 2

Line 8, "a increase" should read --an increase--;
Line 20, "spherical," should read --spherical--;
Line 41, "of" (second occurrence) should be deleted; and
Line 45, "of" (second occurrence) should be deleted.

Column 4

Line 53, "fictionally" should read --frictionally--.

Column 5

Line 18, "composed or formed of hereinunder" should read --composed or formed as set forth hereinunder--;
Line 47, "indefinite form" should read --indefinite-form--; and
Line 65, "contain" should read --contains--.

Column 6

Line 12, "tetrafluioride" should read --tetrafluoride--;
Line 25, "monomethylether" should read --monomethylether,--;
Line 29, "a benzene," should read --as benzene,--; and
Line 42, "actuated" should read --is actuated--.

UNITED STATES PATENT AND TRADEMARK OFFICE

CERTIFICATE OF CORRECTION

PATENT NO. : 5,646,718

DATED : July 8, 1997

INVENTOR(S) : SUWA ET AL.

It is certified that error appears in the above-identified patent and that said Letters Patent is hereby corrected as shown below:

Column 7

Line 32, "having a" should read --having--; and
Line 41, "herinunder" should read --hereinunder--;and
Line 51, "accumulated of" should read --accumulated on--

Column 8

Line 19, "present" should read --prevent--.

Column 9

Line 1, "these both" should read --both these--;
Line 25, "running in" should read --breaking-in--;
Line 29, "60 %" should read --60%--; and
Line 45, "o a" should read --to a--.

Column 10

Line 25, "85 %" should read --85%--;
Line 67, "on" should read --on the-- and "consecutive 6000" should read --6000 consecutive--.

Column 11

Line 7, "consecutive 6000" should read --6000 consecutive--.

UNITED STATES PATENT AND TRADEMARK OFFICE

CERTIFICATE OF CORRECTION

PATENT NO. : 5,646,718

DATED : July 8, 1997

INVENTOR(S) : SUWA ET AL.

It is certified that error appears in the above-identified patent and that said Letters Patent is hereby corrected as shown below:

Column 13

Line 3, "is" should be deleted;
Line 27, "form" should read --from--; and
Line 37, "or" should read --of--.

Column 14

Line 32, "problem" should read --problems--;
Line 44, "tree" should read --three--; and
Line 61, "relationships" should read --is created--.

Column 15

Line 5, "are creased" should read --is created--;
Line 7, "b'" should read --"b'"--;
Line 14, "b'" should read --"b'"--;
Line 28, "b'" should read --"b'"--;
Line 33, "b'" should read --"b'"--;
Line 49, "axially" should read --axial--; and
Line 57, "axially" should read --axial--.

UNITED STATES PATENT AND TRADEMARK OFFICE

CERTIFICATE OF CORRECTION

PATENT NO. : 5,646,718

DATED : July 8, 1997

INVENTOR(S) : SUWA ET AL.

It is certified that error appears in the above-identified patent and that said Letters Patent is hereby corrected as shown below:

Column 16

Line 6, "serve" should read --serves--; and
Line 63, "or" should read --of--.

Column 20

Line 6, "ther-" should read --there--;
Line 7, "ebetween" should read --between--; and
Line 18, "particles spherical" should read --particles have values of a sphericity factor exceeding 130, and said spherical--.

Signed and Sealed this

Seventh Day of April, 1998

Bruce Lehman

*Attest:*

BRUCE LEHMAN

*Attesting Officer*

*Commissioner of Patents and Trademarks*